US005820293A

United States Patent [19]

Groen et al.

[11] Patent Number: 5,820,293

[45] Date of Patent: Oct. 13, 1998

[54] VEHICLE TIRE DEFLATION DEVICE

[75] Inventors: Louis M. Groen, Cincinnati, Ohio; Kenneth J. Greves, Lawrenceburg, Ind.; Richard B. Linnemann, Cincinnati, Ohio

[73] Assignee: Stop Stick, Ltd., Lawrenceburg, Ind.

[21] Appl. No.: 728,959

[22] Filed: Oct. 11, 1996

[51] Int. Cl.[6] ..... E01F 13/12

[52] U.S. Cl. ..... 404/6; 256/1

[58] Field of Search ..... 404/6, 9–11; 256/1, 256/13.1

[56] References Cited

U.S. PATENT DOCUMENTS

| | | | |
|---|---|---|---|
| 1,094,226 | 4/1914 | Le Duc . | |
| 1,232,575 | 7/1917 | Lefort . | |
| 1,276,100 | 8/1918 | Niznik . | |
| 1,721,978 | 7/1929 | Sherwood . | |
| 2,313,388 | 3/1943 | McDonald . | |
| 2,325,260 | 7/1943 | May . | |
| 2,346,713 | 4/1944 | Walker . | |
| 2,353,386 | 7/1944 | Bourcier | 256/1 X |
| 2,912,229 | 11/1959 | Persgard . | |
| 3,652,059 | 3/1972 | Groblebe . | |
| 4,096,782 | 6/1978 | Deschenes . | |
| 4,382,714 | 5/1983 | Hutchison . | |
| 4,473,948 | 10/1984 | Chadwick . | |
| 4,544,303 | 10/1985 | Glasmire . | |
| 4,995,756 | 2/1991 | Kilgrow et al. . | |
| 5,123,774 | 6/1992 | Dubiel | 404/6 |

(List continued on next page.)

FOREIGN PATENT DOCUMENTS 292008 10/1953 Switzerland .

OTHER PUBLICATIONS

Hovey Industries, letter dated Nov. 24, 1992, 2 pages.

The Ottawa Citizen, Monday, May 6, 1991, "Man Arrested After Car Chase", 1 page.

Edgar Brothers, letter dated Apr. 21, 1991, 1 page.

Hovey Industries, undated, "Hollow Spike Belt", 2 pages, attached to Nov. 24, 1992 letter.

Hollow—Spike Belt Acquits Itself Well, 3 pages, 1979.

Spike Belts—A Suitable Alternate to High Speed Pursuits, 2 pages, 1984.

The Hollow Spike Strip: An Improved Vehicle Stopping Device, 7 pages, 1981.

Hollow Spike Strip Study, 13 pages, 1986.

Road Spikes System—Operational Instructions, Sherwood International Export Corporation, 2 pages, undated, attached to Nov. 24, 1992 letter.

Stinger Spike System, Inc., letter dated Sep. 15, 1992, 2 pages.

Stinger Spike System, Inc., brochure, 5 pages, undated, attached to Sep. 15, 1992 letter.

*Primary Examiner*—James Lisehora

*Attorney, Agent, or Firm*—Wood, Herron & Evans, L.L.P.

[57] ABSTRACT

A vehicle tire deflation device comprises a base, a plurality of hollow vehicle tire deflating quills removably secured to the base, and structure, including a curved portion and a flat portion, operably associated with the base, for positioning the device in a tire penetrating orientation so as to penetrate a tire of a vehicle as the tire rolls over the device, upon the device being positioned on a road surface adjacent the vehicle tire to be deflated in a non-tire penetrating orientation; such that the device rolls on the curved portion from the non tire penetrating orientation and comes to rest on the flat portion in the tire penetrating orientation. The device may include a member, operably associated with the base, for removably securing the quills to the base, such that a rolling vehicle tire which embeds one of the quills therein will cause the embedded quill to sever the member and separate from the base, the separated quill thereby remaining in the tire as the tire rolls over the base. The device may further have the quill inner diameter, the number of quills per unit length of base and the length of the base selected so as to deflate a vehicle tire within a predetermined distance of rolling over the device.

23 Claims, 3 Drawing Sheets

U.S. PATENT DOCUMENTS

| | | | |
|---|---|---|---|
| 5,253,950 | 10/1993 | Kilgrow et al. | 404/6 |
| 5,322,385 | 6/1994 | Reisman | 404/6 |
| 5,330,285 | 7/1994 | Greves et al. . | |
| 5,452,962 | 9/1995 | Greves . | |
| 5,482,397 | 1/1996 | Soleau | 404/6 |
| 5,498,102 | 3/1996 | Bissell | 404/6 |
| 5,507,588 | 4/1996 | Marts et al. | 404/6 |
| 5,536,109 | 7/1996 | Lowndes | 404/6 |

OTHER PUBLICATIONS

The Daily Times, Friday, Jan. 10, 1992, "Stinger device maximizes safety while halting high speed chases," 1 page.

Life in the Fast Lane Proves Quite Accelerating As Boy, 9, Leads Officers On a 75–Mile Chase, Undated, 1 page, attached to a Sep. 15, 1992 letter.

High Speed Chase ends with four flats, undated, 1 page, attached to Sep. 15, 1992 letter.

VEHICLE TIRE DEFLATION DEVICE

Field of the Invention

This invention relates generally to law enforcement equipment, and more particularly to devices of the type employed by law enforcement to deflate the tires of a vehicle pursued by law enforcement.

BACKGROUND OF THE INVENTION

Generally, devices for stopping pursued automobiles have taken the form of some type of implement that is placed upon the ground, wherein the implement contains a series of nails or sharp spikes for puncturing the tires and deflating them. Many of the prior art implements were designed to rest upon a road surface in a particular orientation which can be disturbed during deployment of the implement. That is to say, the nails or spikes of the implement, when deployed, must be oriented in a tire penetrating orientation so as to penetrate a tire of a vehicle as the tire rolls over the device. If the implement tips over during deployment, then it becomes virtually useless. Thus, prior art devices of this type can be characterized as being uni-directional, or positionable in the tire penetrating orientation in a single direction only.

One solution aimed at solving this problem is disclosed in U.S. Pat. Nos. 5,330,285 and 5,452,962, both of which are assigned to the assignee of the present invention and hereby incorporated by reference herein as if fully set forth in their entirety. In those patents, there are disclosed apparatus for deflating tires of moving vehicles wherein no matter what orientation the apparatus comes to rest in subsequent to deployment, there will always be a set of spikes or quills which are properly oriented in a vehicle tire penetrating orientation. More specifically, in these patents, the tire penetrating device is triangular in cross section. Each of the three faces of the triangular cross section include a double ended spike lying parallel and adjacent to the face. Further, the spikes are spaced along the length of the device to insure adequate coverage for a vehicle tire. Thus, no matter which of the faces becomes the ground engaging face upon deployment, there will always be spikes properly oriented to deflate the tire of an oncoming vehicle. Therefore, these types of devices can be characterized as tri-directional.

While such a design does insure that there will be spikes properly oriented in a tire penetrating orientation no matter how the device lands or comes to rest during deployment, it will be appreciated that three times as many spikes must be utilized in this type of device over a device which is uni-directional, or which has spikes oriented in only one direction. Thus, the additional spikes increase the costs of manufacturing and assembling the device.

Some uni-directional tire deflation devices include quills or spikes removably secured to a base. The quills or spikes are supposed to separate from the base upon a tire rolling over the device; the embedded quill or spike then provides controlled deflation of the tire.

One problem associated with these designs is that for the quills or spikes to be securely enough retained in or by the base to facilitate assembly and handling of the device, the same prevents the quills or spikes from readily separating from the base when a vehicle tire rolls over the device. Thus, the rolling tire tends to "carry" the device along with it, which is undesirable.

Still further, some law enforcement agencies have specific jurisdictional needs for a tire deflation device. For example, the U.S. Customs Service and Border Patrol have a limited jurisdiction which can be as little as 150 yards within the borders of the United States. Customs thus has a need for a tire deflation device which can be placed ahead of the tires of a stationary vehicle which is being searched or the like, and which will quickly, yet controllably, deflate the vehicle's tires within the limited jurisdiction.

Accordingly, it is one objective of the present invention to provide a vehicle tire deflating device which, when deployed, will always come to rest in a vehicle tire penetrating orientation, yet which does not require the duplication of spikes of prior art devices designed to present spikes in a tire penetrating orientation no matter how the device comes to rest during deployment.

Another objective of the present invention is to provide a vehicle tire deflation device wherein the quills of the device are securely, yet removably, retained in the base, to facilitate assembly and handling of the device, yet which readily separates from the base upon being embedded in a tire which rolls over the device so as not to be carried by the tire.

Yet another objective of the present invention is to provide a vehicle tire deflation device which will quickly, yet controllably, deflate a vehicle's tires within a predetermined distance.

SUMMARY OF THE INVENTION

In accordance with the stated objectives, the present invention is a vehicle tire deflation device comprising a base, a plurality of hollow vehicle tire deflating quills removably secured to the base, and structure, including a curved portion and a flat portion, operably associated with the base, for positioning the device in a tire penetrating orientation so as to penetrate the tire of the vehicle as the tire rolls over the device, upon the device being positioned on a road surface adjacent the vehicle tire to be deflated in a non-tire penetrating orientation. The device rolls on the curved portion from the non-tire penetrating orientation and comes to rest on the flat portion in the tire penetrating orientation.

The base of the device is preferably weighted, and the structure for positioning the device in the tire penetrating orientation preferably comprises a pair of end caps, one of which is secured to each end of the base. Each of the pair of end caps is preferably circular at least in part. The weight of the base causes the device to roll on the end caps until the device is in the tire penetrating orientation. The end caps are preferably semicircular. The semicircular end caps each preferably include a flat formed thereon. The caps are secured to the base such that the flats are spaced beyond a plane of a road-engaging surface of the base which engages the road surface when the vehicle tire rolls over the device. Each end cap preferably includes a rubber pad secured to the flat to prevent the device from slipping out ahead of the vehicle tire as the tire rolls over the device. The base and quills are preferably encased within a protective collapsible plastic cover. The cover is preferably a one-piece unitary sleeve. The base of the device is preferably extruded aluminum, and the quills are preferably fabricated from teflon-coated hardened steel. The quills of the device are received in holes in the base. The quills are positioned perpendicularly to the base when installed in the holes so as to be positioned vertically in a tire-penetrating orientation when the flat portion of the device engages the road surface upon which the device is positioned. The quills are preferably positioned medially of the transverse extent of the base. The device, including the base and quills encased within the cover, is preferably triangular in cross section.

According to another aspect of the present invention, the base of the vehicle tire deflation device includes a member within the base which passes through the quills to removably retain the quills in the holes in the base. The member is preferably a wire threaded through the base and further through holes in the quills. The wire is preferably manufactured to a diameter and fabricated of a material such that a rolling vehicle tire which embeds one of the quills therein will cause the embedded quill to sever the wire, the embedded quill thereby separating from the base and remaining in the tire as the tire rolls over the base. The wire is preferably fabricated of vinyl material, and preferably has a diameter of about 0.060 inches. The quills preferably have an outer diameter of about 0.375 inches. The holes in the base preferably have a diameter of about 0.3795 inches.

According to yet another aspect of the present invention, the quills have an inner diameter, the quills are spaced along the base a given number of quills per unit length of base, and the base has a given length. The quill inner diameter, the given number of quills per unit length of base and the given length of the base are selected so as to deflate a vehicle tire within a predetermined distance of rolling over the device.

The inner diameter of the quills is preferably about 0.312 inches, the given number of quills per unit length of base is preferably one quill per every about 3.187 inches, and the given length of the base is preferably about 23.125 inches. The predetermined distance within which the tires deflate is preferably under 150 yards.

According to still a further aspect of the present invention, the base of the tire deflation device may include a pair of members within the base corresponding to each quill. One member of the pair of members passes through the quill from one side and the other member of the pair of members passes through the quill from the other side. The pair of members preferrably pass only partially through the quill, i.e. the pair of members, being a pair of wires, one wire of which passes through the base and is threaded through the hole in one side of the quill, and the other wire of which is threaded through the base and passes through the hole in the other side of the quill.

One advantage of the present invention is that a tire deflation device is provided which includes only a single set of uni-directional quills, thus making the device less expensive to manufacture and assemble, yet which does not suffer the attendant disadvantages of prior uni-directional quill devices which require the quills to be precisely and carefully placed in the tire penetrating orientation, and require the avoidance of any disturbances after so placing the device, since should the device be tipped over subsequently thereto it is useless for penetrating tires. The device of the invention is "self-righting" which is to say that no matter what orientation the quills initially are in during deployment, the device automatically rights itself so that the quills assume the tire penetrating orientation.

Another advantage of the present invention is that the outside diameter of the quills and the diameter of the holes in the base are sized to allow the quills to readily slide out of the holes in the base to be carried away from the base by the tire into which the quills are embedded, once the restraining member or wire has been severed by the quills. Yet, the restraining wire or member securely retains the quills in the base during assembly and handling of the device.

Yet another advantage of the present invention is that the inner diameter of the quills, in combination with the length of the base and the number of quills per unit length of base, are all sized to quickly yet controllably deflate the tire of a moving vehicle, such deflation occurring within a predetermined distance, for example under one hundred fifty yards of a vehicle running over the device, and within about 3–6 seconds.

These and other objects and advantages of the present invention will become readily apparent during the following detailed description taken in conjunction with the drawings herein, in which:

DETAILED DESCRIPTION OF THE INVENTION

Figure 1:
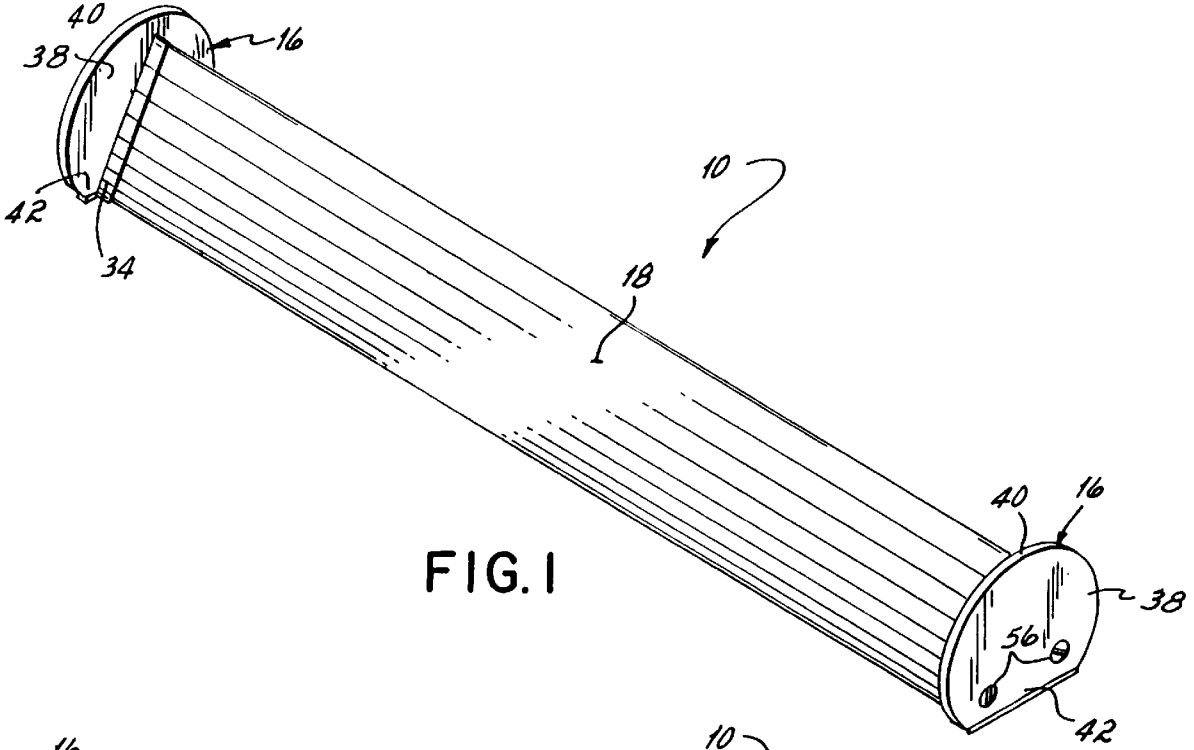
FIG. 1 is a perspective view of the tire deflation device of the present invention.
Figure 2:
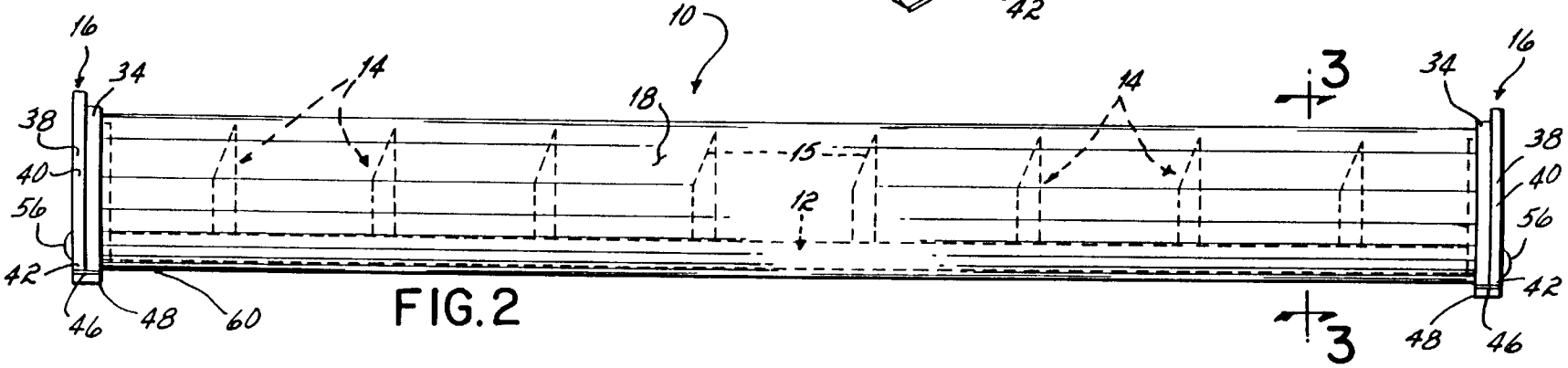
FIG. 2 is a side elevational view of the present invention.

Referring first to FIGS. 1 and 2, there is illustrated a vehicle tire deflation device 10 according to the principles of the present invention. The device 10 includes, generally, a base 12, a plurality of hollow quills 14 removably secured to the base 12, an end cap assembly 16 secured to each end of the device 10 and a protective collapsible plastic cover 18 surrounding the quills 14 and base 12.

Figure 3:
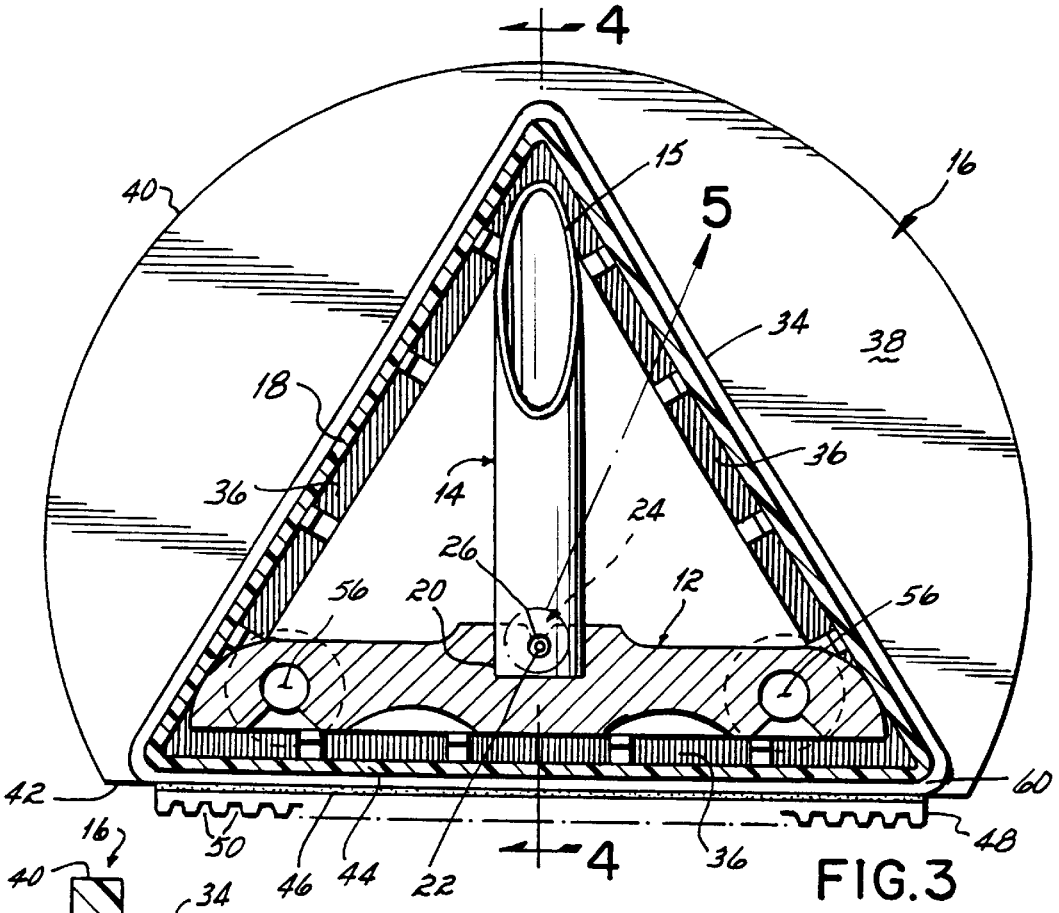
FIG. 3 is a view taken along line 3—3 of FIG. 2.
Figure 4:
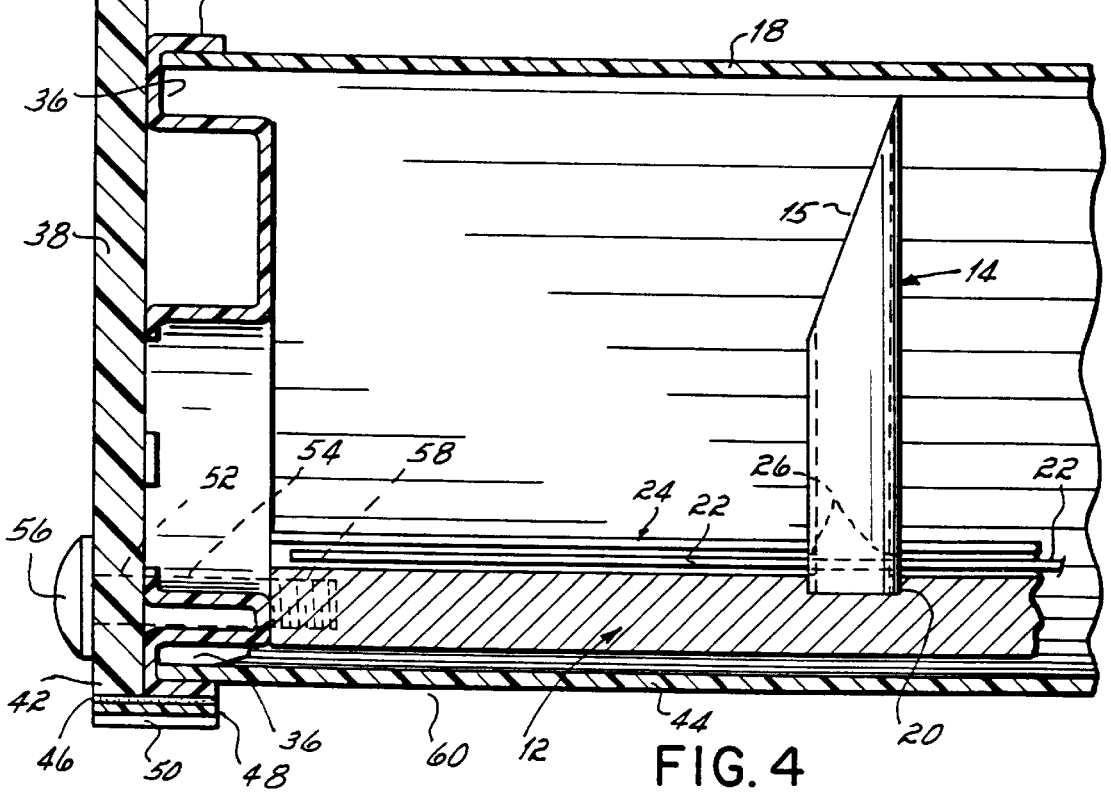
FIG. 4 is a view taken along line 4—4 of FIG. 3.

Referring now to all of the Figures, the base 12, preferably fabricated of extruded aluminum, includes a plurality of holes 20 therein each of which accepts one of the quills 14. The quills 14 are preferably fabricated of teflon-covered hardened steel, and have an inner diameter of about 0.312 inches, an outer diameter of about 0.375 inches and a length of about 1.937 inches. Quills 14 have upper ends 15 cut on a bias not unlike that of a hypodermic needle, preferably at an angle of about 22 degrees relative to a longitudinal axis of the quills 14. The ends 15 are preferably oriented relative to the base 12 as illustrated in FIGS. 2–4, i.e. with the bias cut of the ends 15 oriented toward an end of the base 12, to insure proper penetration of the quills 14 through the cover 18 and into a vehicle tire. To facilitate the withdrawal of the quills 14 from the holes 20 in the base 12, lubricant, for example grease, may be applied to the base of the quills 14 which is received in the holes 20. Further, holes 20 preferably have a diameter of about 0.3795 inches and a depth of about 0.230 inches. As will be discussed below in more detail below, the difference in diameters of the outer diameter of the quill 14 and the hole 20 allow for the quills 14 to readily separate from the base 12 and remain embedded in a tire which has rolled over the device 10. The quills 14 are spaced along the base 12 at one quill per every about 3.187 inches (as measured between centerlines of the quills). The base 12 of the device 10 is preferably about 23.125 inches long. The sizing of the inner diameter of the quills 14, along with the spacing of the quills 14 along the length of the base 12 and the length of the base 12 insures that a vehicle will have its tires fully deflated under one hundred fifty yards after running over the device and within about 3–6 seconds. The device 10, as designed, is especially useful along the borders of the United States, where the United States Customs Service has a limited jurisdiction. Thus, it is preferable when Customs utilizes the device 10 in connection with a vehicle stop and search at the border, for that vehicle to have its tires fully deflated within the limited jurisdiction of Customs should the vehicle occupants attempt to flee within the country.

As is illustrated in the drawings, the quills 14 are positioned medially of the transverse extent of the base 12 and in a single straight line. As described above, the base 12 and quills 14 are encased within a protective collapsible plastic cover 18, which preferably is a one-piece unitary sleeve fabricated of 0.032 in. thick HDPE (high density polyethylene). The base 12 and quills 14 encased within the cover 18 preferably is triangular in cross section, though other cross sections may be utilized.

Figure 5:
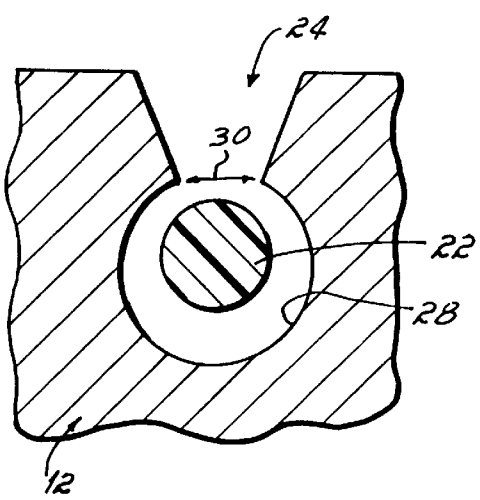
FIG. 5 is the encircled area 5 of FIG. 3, enlarged.

Referring now particularly to FIGS. 3–5, the base 12 includes a member 22 which is threaded through a groove 24 which runs the length of the base 12. Member 22 is preferably a wire which in addition to being threaded through the groove 24 in the base 12, is threaded through holes 26 in the sides of each quill 14. The holes 26 are preferably 0.093 inches in diameter. Groove 24 includes a semicircular area 28 which has a diameter, preferably of about 0.062 inches. There is an opening 30 at the upper end of the semicircular area 28 which has a width dimension of about 0.044 inches. The wire 22 is preferably manufactured to a diameter and fabricated of a material such that a rolling vehicle tire which embeds one of the quills 14 therein will cause the embedded quill 14 to sever the wire 22, with the embedded quill thereby separating from the base 12 and remaining in the tire as the tire rolls over the base 12. The retaining wire 22 serves to retain the quills 14 in the holes 20 and the base 12 during assembly and handling of the device 10, and maintain the proper orientation of the ends 15 of the quills 14 with respect to the base 12, yet is easily severed by the quill 14 as the tire rolls over the device 10, thus insuring that the quills 14 will separate from the base 12 and remain in the tire rather than the quills 14 carrying the base 12 and the entire device 10 along with the tire as the vehicle continues in motion. Wire 22 is preferably manufactured of vinyl material, and preferably has a diameter of about 0.060 inches.

As previously stated, an end cap assembly 16 is attached to each end of the device 10. Each end cap assembly 16 includes a generally triangular end cap portion 34 which includes a channel 36 therein for receiving the end edges of the triangular collapsible protective cover 18. End cap portion 34 is preferably fabricated of plastic. A semicircular end cap portion 38, likewise preferably fabricated of plastic, abuts the triangular end cap portion 34. The end cap portion 38 includes a semicircular portion 40 and a flat portion 42. Flat portion 42 is adhered to one of the three walls 44 of the triangular end cap portion 34, which walls 44 form the outer leg of channel 36. A piece of double-sided tape 46 is adhered to both the flat 42 and the wall 44 thereby securing the end cap portion 38 to the end cap portion 34. On the lower side of the double-sided tape 46 is a rubber foot 48 which includes serrations 50. The foot 48 with the serrations 50 is to prevent device 10 from slipping out ahead of a vehicle tire as the tire rolls over the device 10. Double-sided tape 46 may be such as that manufactured by 3M of St. Paul, Minn. as part number 06382. Clearance holes 52 and 54 in the end cap portions 38 and 34, respectively, permit screws 56 to be threaded into tapped holes 58 in the ends of the base 12. As is seen in FIG. 4, the combination of wall 44, flat 42, double-sided tape 46 and rubber foot 48 provides a ground-engaging surface which extends beyond, or below, a plane 60 defined by the base 12 with cover 18 thereon, which plane, of course, will engage the road surface upon a vehicle tire rolling over the device 10. The combination of semicircular end cap portion 38, the weight of the base 12, and the relative position therebetween, insure that upon placing the device 10 on a road surface adjacent the vehicle tire to be deflated in any non-tire penetrating orientation, i.e., with the quills 14 positioned in other direction other than vertically upwardly, the device 10 will automatically right itself by positioning itself in a tire penetrating orientation with the quills 14 positioned vertically upwardly so as to be in a position to penetrate a tire of a vehicle as the tire rolls over device 10, by virtue of the device 10 rolling on the curved portion 40 of the end cap portion 38 and coming to rest on the flat portion which, in the illustrated embodiment, is the rubber foot 48.

Figure 6:
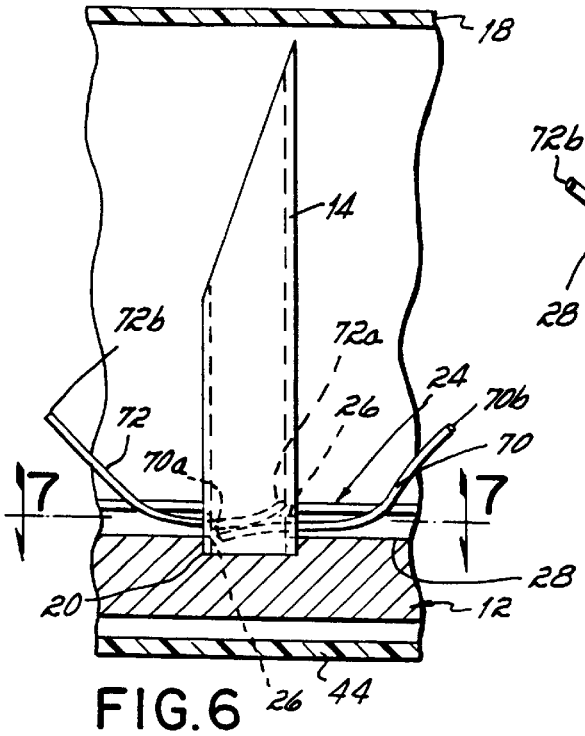
FIG. 6 is a partial side elevational view, in partial cross-section, of an alternative quill mounting arrangement.
Figure 7:
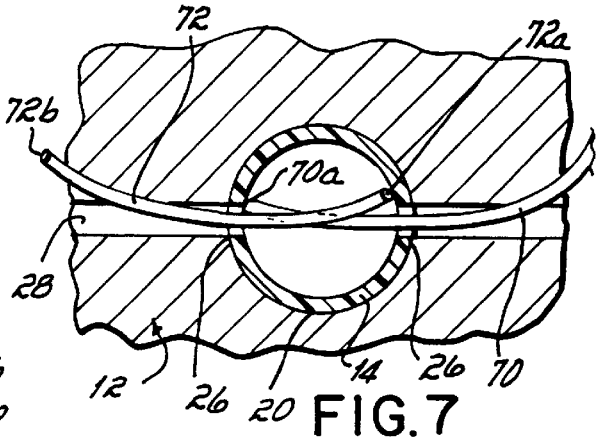
FIG. 7 is a view taken along 7—7 of FIG. 6.

Referring now to FIGS. 6 and 7, there is illustrated an alternative quill mounting arrangement. With like numbers representing like elements, quill 14 is secured in hole 20 via two separate short lengths of wire 70 and 72. Short lengths of wire 70 and 72 are of the same material and size as the wire 22 described above. In this alternative mounting arrangement, forward end 70*a* of wire 70 is advanced through one hole 26 of the quill 14 until it abuts the opposite inner quill wall. Similarly, forward end 72*a* of wire 72 is advanced through the other hole 26 until it abuts the opposite inner quill wall. The balance of the wires 70 and 72, except for the rear ends 70*b* and 72*b*, respectively, are forced downwardly through the gap 30 and into the semicircular area 28. By not forcing the entirety of the wire 70 and 72 into the semicircular area 28, i.e. by leaving the rear ends 70*b* and 72*b*, respectively, upturned, this arrangement prevents undesirable slipping of the quill 14 along the base 12 yet allows the quills to be removably retained to the base 12 so that when embedded in a tire the quill separates readily from the base 12. In this alternative attachment scheme, since there are two separate wires which removably attach the quill to the base, i.e., since the wires are already "severed", the action of a tire rolling over the quill, embedding the quill in the tire and then carrying the quill with the tire causes the quill to separate from the base and the wires to either remain with the base, i.e. the wires pull out of the quill.

Those skilled in the art will readily recognize numerous adaptations and modifications which can be made to the present invention which will result in an improved vehicle tire deflation device, yet all of which will fall within the spirit and scope of the present invention as defined in the following claims. For example, end cap assemblies 16 comprising portions 34 and 38 could easily be fabricated as a single-piece part. Further, while curved portion 40 of the end cap portion 38 has been described as being semicircular, it would be appreciated that many other curvatures could as well be utilized, the only requirement being that this portion be curved to allow rolling thereon. Accordingly, the invention is to be limited only by the scope of the following claims and their equivalents.

What is claimed is:

1. A vehicle tire deflation device comprising:

a base;

a plurality of hollow vehicle tire deflating quills removably secured to said base; and structure, including a curved portion and a flat portion, operably associated with said base, for positioning said device in a tire penetrating orientation so as to penetrate a tire of a vehicle as the tire rolls over said device, upon said device being positioned on a road surface adjacent the vehicle tire to be deflated in a non tire penetrating orientation with said quills pointing toward the road surface;

said device being operable to upright itself by rolling on said curved portion from the non tire penetrating orientation and coming to rest on said flat portion in the tire penetrating orientation with said quills pointing away from the road surface.

2. The vehicle tire deflation device of claim 1 wherein said base and quills are encased within a protective collapsible plastic cover.

3. The vehicle tire deflation device of claim 2 wherein said protective collapsible plastic cover is a one piece unitary sleeve.

4. The vehicle tire deflation device of claim 1 wherein said base is extruded aluminum.

5. The vehicle tire deflation device of claim 1 wherein said quills are fabricated from teflon covered hardened steel.

6. The vehicle tire deflation device of claim 1 wherein said quills are received in holes in said base, said quills being positioned perpendicularly to said base when installed in said holes so as to be positioned vertically in the tire penetrating orientation when said flat portion engages the road surface upon which said device is positioned.

7. The vehicle tire deflation device of claim 6 wherein said base includes a member within said base and which passes through said quills to removably retain said quills in said holes in said base.

8. The vehicle tire deflation device of claim 7 wherein said member is a wire threaded through said base and threaded through holes in said quills.

9. The vehicle tire deflation device of claim 8 wherein said wire is manufactured to a diameter and fabricated of a material such that a rolling vehicle tire which embeds one of said quills therein will cause said embedded quill to sever said wire, said embedded quill thereby separating from said base and remaining in the tire as the tire rolls over said base.

10. The vehicle tire deflation device of claim 9 wherein said wire is fabricated of vinyl material.

11. The vehicle tire deflation device of claim 9 wherein said wire has a diameter of about 0.060 inches.

12. The vehicle tire deflation device of claim 9 wherein said quills have an outer diameter of about 0.375 inches.

13. The vehicle tire deflation device of claim 9 wherein said holes have a diameter of about 0.3795 inches.

14. The vehicle tire deflation device of claim 1 wherein said quills are positioned medially of the transverse extent of said base.

15. A vehicle tire deflation device comprising:

a base;

a plurality of hollow vehicle tire deflating quills removably secured to said base;

structure, including a curved portion and a flat portion, operably associated with said base, for positioning said device in a tire penetrating orientation so as to penetrate a tire of a vehicle as the tire rolls over said device, upon said device being positioned on a road surface adjacent the vehicle tire to be deflated in a non tire penetrating orientation;

said device rolling on said curved portion from the non tire penetrating orientation and coming to rest on said flat portion in the tire penetrating orientation; and wherein said base is weighted and wherein said structure for positioning said device in a tire penetrating orientation comprises:

pair of end caps, one of which is secured to each end of said base, each of said pair of end caps being circular at least in part, the weight of said base causing said device to roll on said end caps until said device is in the tire penetrating orientation.

16. The vehicle tire deflation device of claim 15 wherein said caps are semicircular.

17. The vehicle tire deflation device of claim 16 wherein said semicircular end caps each include a flat formed thereon, said caps being secured to said base such that said flats are spaced beyond a plane of a surface of said base which engages a road surface when the vehicle tire rolls over said device.

18. The vehicle tire deflation device of claim 17 wherein each said end cap includes a rubber pad secured to said flat to prevent said device arom slipping out ahead of the vehicle tire as the tire rolls over said device.

19. A vehicle tire deflation device comprising:

a base;

a plurality of hollow vehicle tire deflating quills removably secured to said base;

structure, including a curved portion and a flat portion, operably associated with said base, for positioning said device in a tire penetrating orientation so as to penetrate a tire of a vehicle as the tire rolls over said device, upon said device being positioned on a road surface adjacent the vehicle tire to be deflated in a non tire penetrating orientation;

said device rolling on said curved portion from the non tire penetrating orientation and coming to rest on said flat portion in the tire penetrating orientation; and wherein said device including said base and quills encased within said cover is triangular in cross-section.

20. A vehicle tire deflation device comprising:

a base;

plurality of hollow vehicle tire deflating quills removably secured to said base;

structure, including a curved portion and a flat portion, operably associated with said base, for positioning said device in a tire penetrating orientation so as to penetrate a tire of a vehicle as the tire rolls over said device, upon said device being positioned on a road surface adjacent the vehicle tire to be deflated in a non tire penetrating orientation;

said device rolling on said curved portion from the non tire penetrating orientation and coming to rest on said flat portion in the tire penetrating orientation;

wherein said quills are received in holes in said base, said quills being positioned perpendicularly to said base when installed in said holes so as to be positioned vertically in the tire penetrating orientation when said flat portion engages the road surface upon which said device is positioned; and wherein said base includes a pair of members within said base corresponding to each said quill, one member of said pair of members passing through said quill from one side and the other member of said pair of members passing through said quill from the other side.

21. The vehicle tire deflation device of claim 20 wherein said pair of members pass only partially through said quill.

22. The vehicle tire deflation device of claim 21 wherein said pair of members are wires threaded through said base and threaded through holes in said quills.

23. A vehicle tire deflation device comprising:

a base;

plurality of hollow vehicle tire deflating quills removably secured to said base;

structure, including a curved portion and a flat portion, operably associated with said base, for positioning said device in a tire penetrating orientation so as to penetrate a tire of a vehicle as the tire rolls over said device, upon said device being positioned on a road surface adjacent the vehicle tire to be deflated in a non tire penetrating orientation;

said device rolling on said curved portion from the non tire penetrating orientation and coming to rest on said flat portion in the tire penetrating orientation;

a member, operably associated with said base, for removably securing said quills to said base, such that a rolling vehicle tire which embeds one of said quills therein will cause said embedded quill to separate from said base, said separated quill thereby remaining in the tire as the tire rolls over said base;

said quills having an inner diameter;

said quills being spaced along said base a given number of quills per unit length;

said base having a given length;

said quill inner diameter, said given number of quills per unit length of base and said given length of base being selected so as to deflated a vehicle tire within a predetermined distance of rolling over said device.

* * * * *

UNITED STATES PATENT AND TRADEMARK OFFICE

CERTIFICATE OF CORRECTION

PATENT NO. : 5,820,293

DATED : October 13, 1998

INVENTOR(S) : Louis M. Groen, Kenneth J. Greves and Richard B. Linnemann

It is certified that error appears in the above-indentified patent and that said Letters Patent is hereby corrected as shown below:

Column 3, line 35, "preferrably" should read -- preferably --.

Column 4, line 51, "As will be discussed below in more detail below" should read -- As will be discussed in more detail below --.

Column 7, line 61, "pair of end caps" should read -- a pair of end caps --.

Column 8, line 8, "arom" should read -- from --.

Column 8, line 29, "plurality" should read -- a plurality --.

Column 8, line 59, "plurality" should read -- a plurality --.

Column 10, line 7, "deflated" should read -- deflate --.

Signed and Sealed this

Eighth Day of June, 1999

*Attest:*

Q. TODD DICKINSON

*Attesting Officer*

*Acting Commissioner of Patents and Trademarks*